US005666678A

United States Patent [19]

Wall

[11] Patent Number: 5,666,678

[45] Date of Patent: Sep. 16, 1997

[54] GROUND COVERING SYSTEM

[76] Inventor: Cameron Frank Wall, 2983 Emerald Chase, Tallahassee, Fla. 32308

[21] Appl. No.: 613,542

[22] Filed: Mar. 11, 1996

[51] Int. Cl.[6] ..... A47G 9/06

[52] U.S. Cl. ..... 5/417; 135/118; 224/575; 224/679

[58] Field of Search ..... 5/417–420; 190/1, 190/2; 383/4; 52/3; 135/118; 224/575, 679; 2/69, 69.5, 89

[56] References Cited

U.S. PATENT DOCUMENTS

| | | | |
|---|---|---|---|
| 2,618,790 | 11/1952 | Ritchey | 383/4 |
| 3,976,113 | 8/1976 | Kim | 150/12 |
| 4,222,468 | 9/1980 | DeFries | 5/417 |
| 4,709,430 | 12/1987 | Nicoll | 5/417 |
| 4,951,333 | 8/1990 | Kaiser et al. | 5/417 |
| 4,970,741 | 11/1990 | Sping | 5/417 |
| 5,245,715 | 9/1993 | Dinkins | 5/417 |
| 5,299,331 | 4/1994 | Bodillo | 5/417 |
| 5,435,025 | 7/1995 | Gerard et al. | 5/419 |
| 5,520,364 | 5/1996 | Bloxon et al. | 5/417 |

*Primary Examiner*—Alexander Grosz
*Attorney, Agent, or Firm*—Peter Loffler

[57] ABSTRACT

A ground covering system comprises a blanket having a pair of opposedly disposed weights, having optional spikes thereon. An optionally weighted case, having a slitted aperture, is comprised of two halves, each half having optional spikes thereon and attached to the blanket. The case assists in securement of the ground covering system to the ground. The case receives the blanket with weights and has convenient transport means.

13 Claims, 5 Drawing Sheets

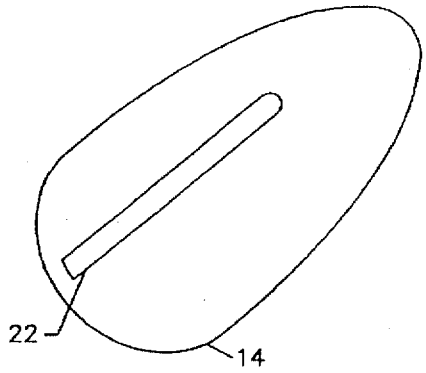
FIG. 4A
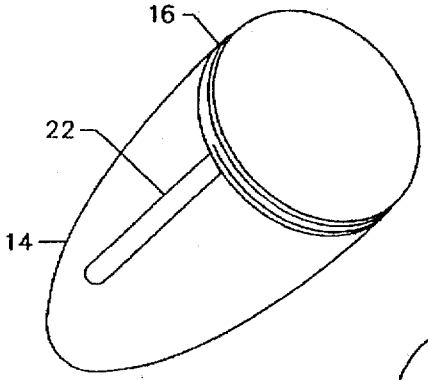
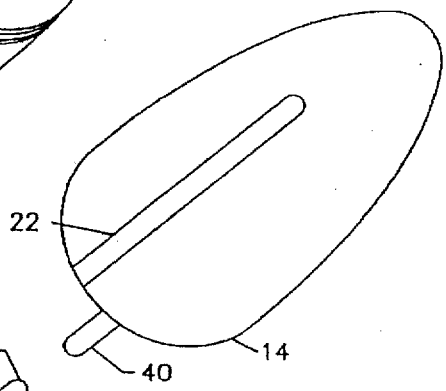
FIG. 4B
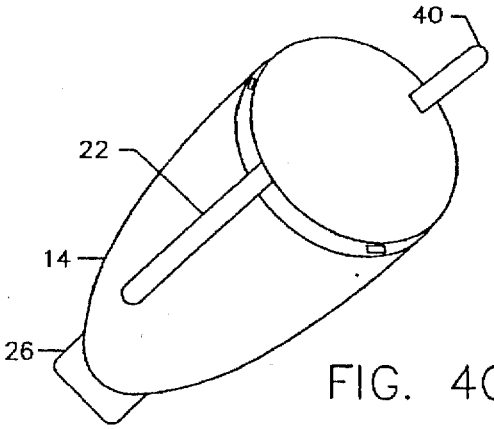
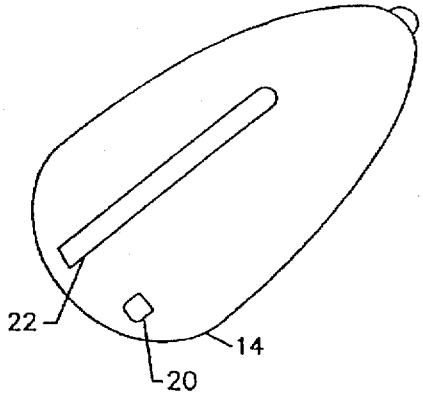
FIG. 4C
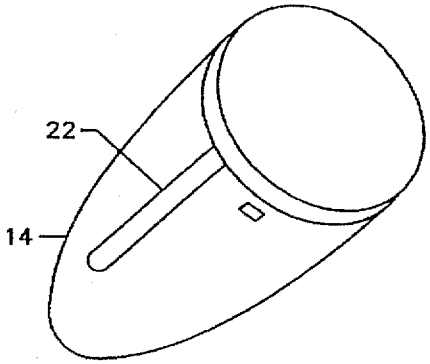

GROUND COVERING SYSTEM

BACKGROUND OF THE INVENTION

1. Field of the Invention

The present invention relates to blankets and more specifically to weighted beach blankets and similar devices having convenient carrying means.

2. Background of the Prior Art

Blankets, drop clothes and other ground coverings are commonly used to separate a person sitting on the ground from the ground itself. Typically, blankets are used at beaches and parks. Once positioned, on the ground, these coverings are readily subject to disarray from the effects of wind and human usage. This results in reduced usage area of the covering as well as discomfort to the user.

In order to overcome such disordering of a blanket, people will attempt to anchor the corners of the blanket with shoes, bags, and similar objects. Such make-shift anchoring, is inefficient and is not available at all if the user desires to keep his shoes on or otherwise has no anchoring devices.

As a result, many devices have been proposed in order to anchor a blanket onto a surface. Exemplary of such devices is U.S. Pat. No. 4,709,430 issued to Nicoll. The Nicoll device consists of a blanket having a hollow tubular member extending along the blanket's periphery. A liquid, such as water, is disposed within the tubular member and acts as a weight means. This device is difficult and messy to use and is relatively expensive to make.

Therefore, there is a need in the art for effectively weighting and anchoring a ground covering. Such a device should be simple and straightforward to use and should not be messy to use. The device should be simple and inexpensive to manufacture. Ideally, the device will prove convenient to transport.

SUMMARY OF THE INVENTION

The ground covering system of the present invention meets the aforementioned needs in the art. The ground covering system is comprised of a carrying case that splits into two halves. Each half, which is slitted to allow case attachment means to pass therethrough, can be optionally weighted. A blanket has weights located thereon in opposing orientation. Each case attaches to the blanket at an appropriate point. The weights and the halves each have an optional spike for perforation of the ground.

The blanket is positioned on the ground and the weights hold two of the blanket's corners in place. The other corners of the blanket are attached to the case halves which halves hold these two corners in place. In a generally circular-shaped blanket, the weights and case attachment points are spaced at 90 degree intervals.

The case is dimensioned to receive the blanket, blanket attachment means, and weights. The case is attachable to a belt or can be equipped with a carrying handle.

The device is easy and efficient to use and is of relatively simple construction. The device securely holds the blanket in place without undue work or mess. The device is convenient to transport.

Figure 5B:
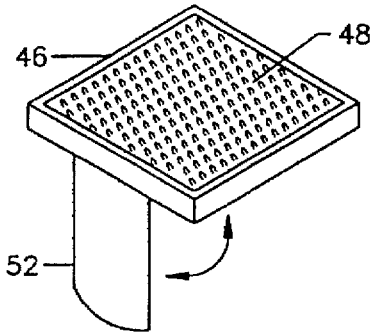
Figure 5A:
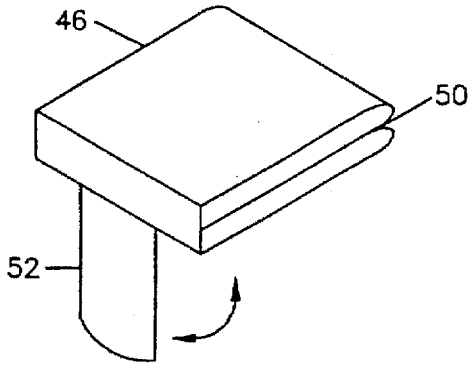
Figure 1:
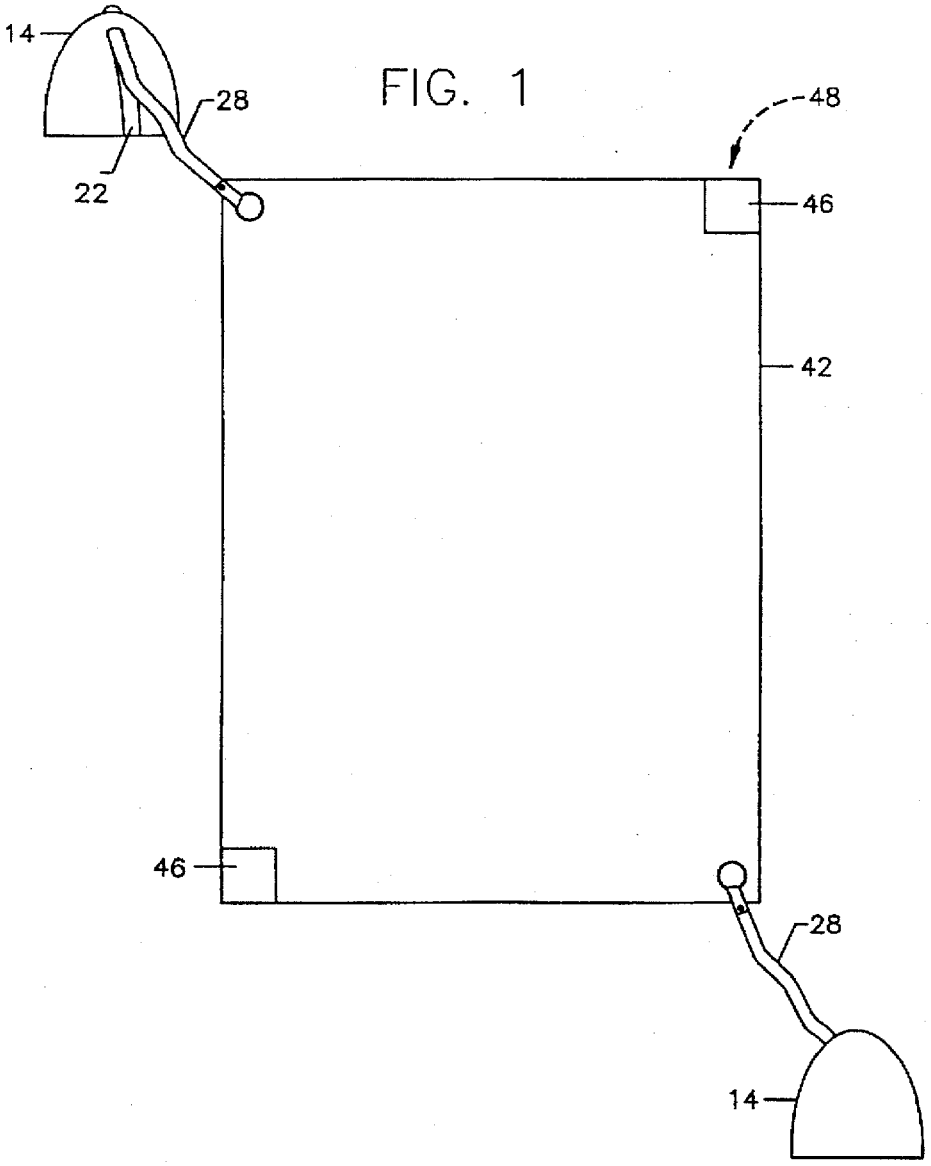
FIG. 1 is an isometric view of the ground covering system of the present invention positioned on the ground.
Figure 2:
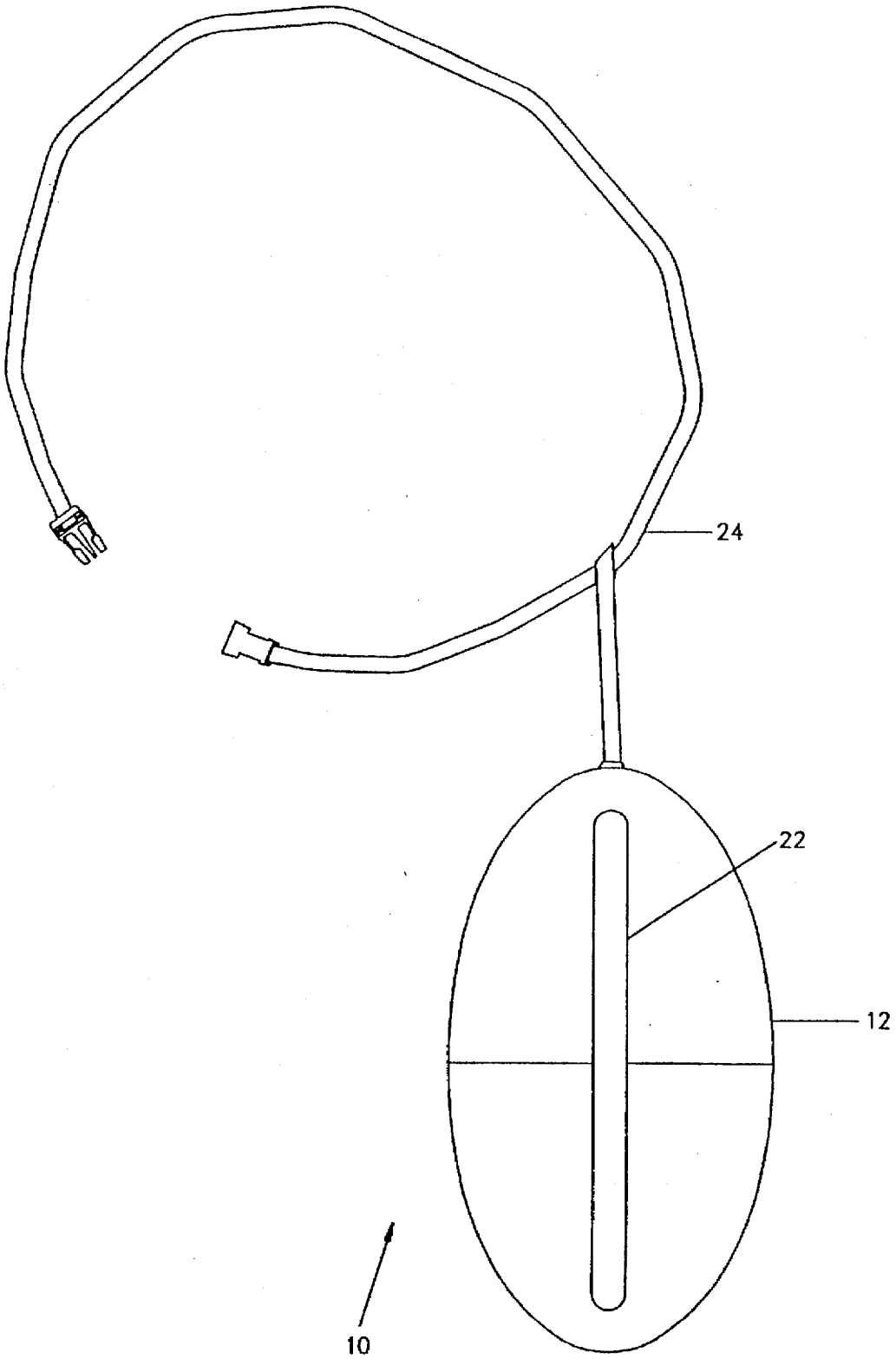
FIG. 2 is an isometric view of the ground covering system of the present invention attached to a belt.
Figure 3:
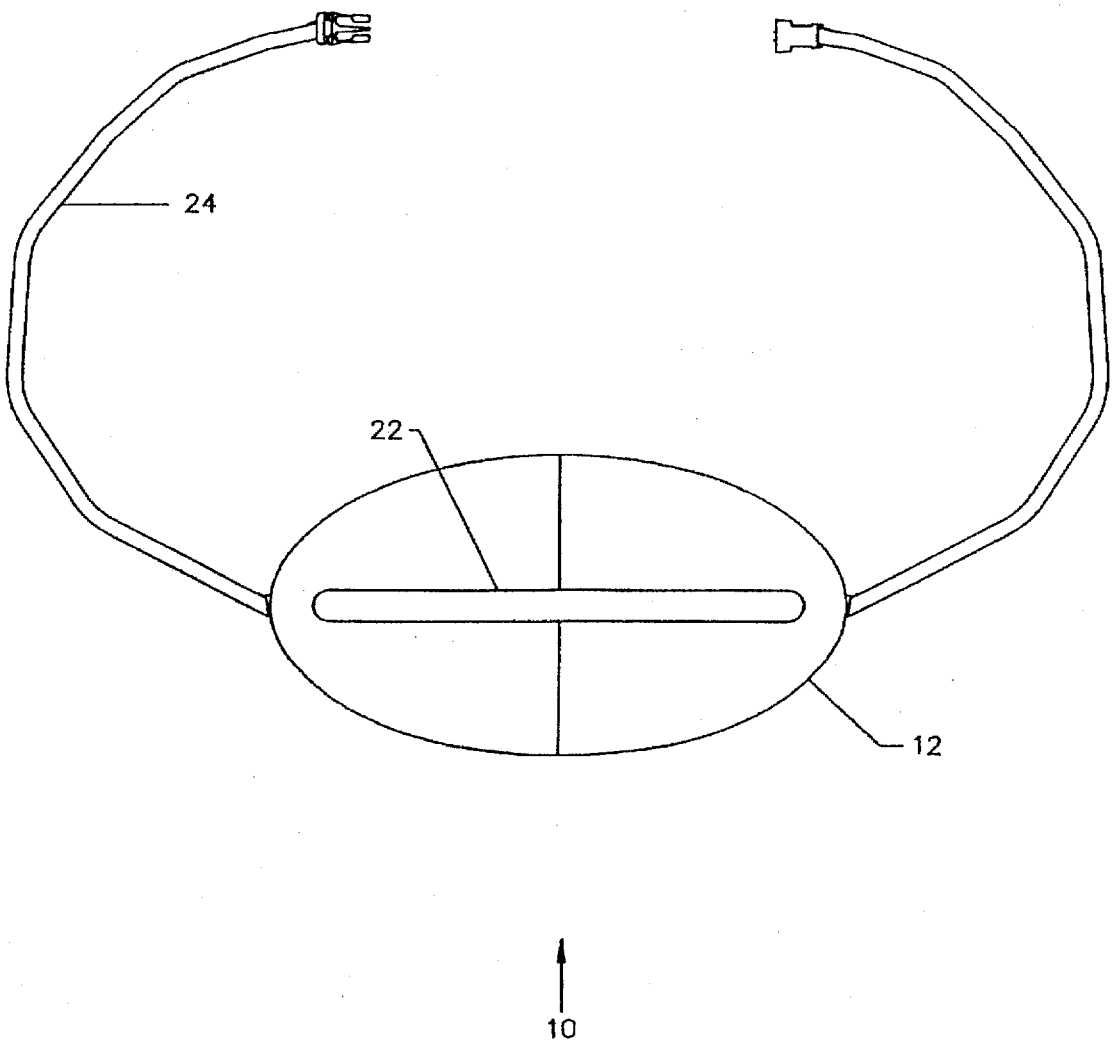
FIG. 3 is an isometric view of the ground covering system of the present invention attached to a belt in alternate fashion.
Figure 6A:
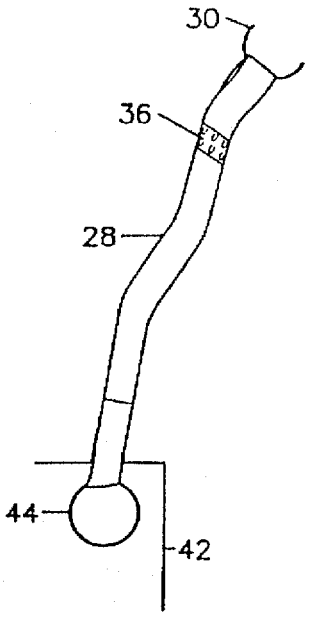
Figure 6B:
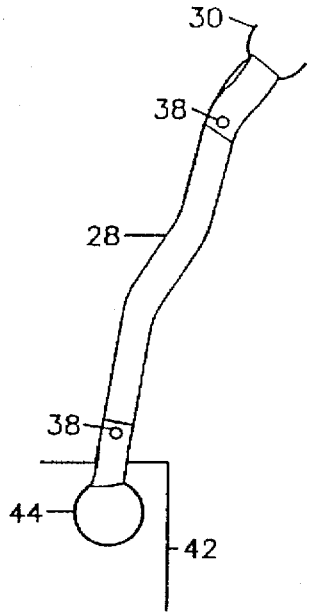
Figure 6C:
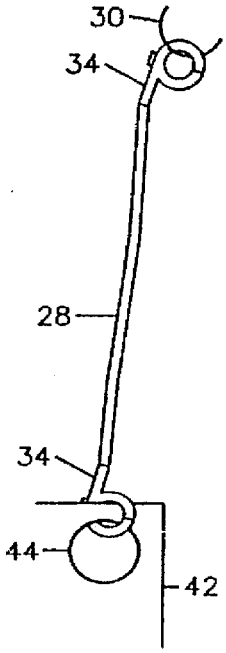
Figure 6D:
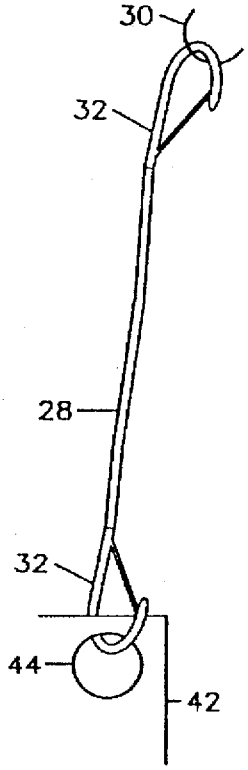

FIGS. *4a–4c* illustrate the various means for securing the first half to the second half.

FIGS. *5a* and *5b* illustrate the various removably attachable weights.

FIGS. *6a–6d* illustrate the various means for connecting the straps to the halves and to the ground covering.

Similar reference numerals refer to similar parts throughout the several views of the drawings.

DETAILED DESCRIPTION OF THE PREFERRED EMBODIMENT

Referring now to the drawings, it is seen that the ground covering system of the present invention, generally denoted by reference numeral 10, comprises a case 12. The case, which can be of any appropriate geometric shape, is comprised of a first half 14 and a second half 14. The halves 14, which may or may not be symmetric, cooperate with each other so that the halves 14 can come together and remain in a securely mateable and closed position. This can be accomplished by providing threading on each half 14, male threading 16 on one half 14 and female threading on the other half 14, and permitting threadable securement of the halves 14 to each other. Alternately, a clasp system 20, a bayonet-type system, or any other appropriate system can be utilized to securely hold the two halves 14 in a releasably closed configuration. Each half 14 may be weighted. Each half 14 has a slit 22, which can terminate at or before the outer periphery of the edge of the half 14.

Means are provided so that the halves 14 can be utilized with and removably attachable to a belt 24 permitting ease of carrying of the device 10 around a user's waist. Such means can include a buckle (not illustrated) through which the belt 24 can be passed. Alternatively, a resilient spring clip (not illustrated) can be used to clip the device 10 onto the belt 24, the top of a user's pants, or other similar surface. As a further alternative, one half of cooperating hook and loop (Velcro) material (not illustrated) can be located on the outside of the case 12 with the other half of Velcro located on the target attachment surface. Alternatively, the case 12 can have a carrying handle 26 located thereon.

Attachable within the interior of each half 14, is a case strap attachment means for removable attachment of a strap 28 thereto. The case strap attachment means can be of any appropriate type including a circular ring 30, locatable on each half 14, with a cooperating spring hook 32 or spring clip 34 located on the strap 28. Alternately, Velcro 36 or a clasp 38 can comprise the case strap attachment means. Alternatively, the strap 28 may be either knotted to or can otherwise be permanently attached to the half 14.

An optional spike 40 can be attached to each half 14 in any appropriate fashion. The spike 40 may be located within the interior of its half 14 and can be either pivotally or slidably exposed. Alternately, the spike 40 may be pivotally attached to the exterior of the half 14.

A blanket 42 or other similar ground covering of any appropriate geometric shape has a blanket strap attachment means located at two points on the blanket. Such points are opposed to each other. In a generally rectangular blanket configuration, the two points would be located on two opposing corners. In a generally circular blanket configuration, the two points would be located 180 degrees apart. The blanket strap attachment means can be identical to the case strap attachment means except that a grommet 44 positioned through the blanket 42, would be used in place of the ring 30, if a spring hook 32 or spring clip 34 is used as the blanket strap attachment means. Alternatively, the strap 28 may be knotted to or can otherwise be permanently attached to the blanket 42.

Located on two points on the blanket are weights 46. These two points are located opposite each other and away from the two strap receiving points. In a generally rectangular blanket configuration, the two points would be located on two opposing corners opposite the corners having the strap receiving points. In a generally circular blanket configuration, the two points would be located 180 degrees apart and 90 degrees apart from the strap receiving points.

The weights 46 can be either removably or permanently attached to the blanket 42. If the weights 46 are removably attached to the blanket 42, Velcro 48 can be utilized, with one section of the Velcro 48 located on a surface of the weight and the cooperating section of Velcro 48 located on the surface of the blanket 42. Alternately, the weight 46 can have a clamp 50 wherein the blanket 42 is friction held within the clamp 50.

An optional spike 52 can be fixedly or pivotally positioned on the bottom of each weight 46. In a closed position, the pivotally positioned spike 52 will be flush with the surface of the weight 46.

In order to utilize the ground covering system 10 of the present invention, one of the weight-bearing corners of blanket 42 is positioned on the ground. The optional spike 52 of the weight 46 is pivoted, if pivotally attached, into an open downward position and perforates the ground. Thereafter, the other weight-bearing corner of the blanket 42 is positioned on the ground. The optional spike 52 of this weight 46 is pivoted into an open downward position and perforates the ground. Thereafter, one half 14 of the case is appropriately positioned. Its optional spike 40 is opened, if required, and perforates the ground. The strap 28 rises up through the slit 22 to prevent the strap's submersion into the ground as the half 14 is partially submerged into the ground until stable. The strap 28 connects the blanket 42 with the half 14. Thereafter, the other half 14 of the case 12 is appropriately positioned. Its optional spike 40 is pivoted into an open downward position, if required, and perforates the ground. The strap 28 connects the blanket 42 with this half 14. The blanket 42 is now in a fully extended position and is appropriate for use. The weights 46 and the weighted halves 14 hold the blanket 42 in its extended position. The optional spikes 40 and 52, located on the halves 14 and weights 46 respectively, add further stability in holding the blanket 42 in an open position.

Upon completion of blanket 42 usage, the halves 14 are disconnected from the blanket 42. The optional spikes 40 and 52 are placed into a closed position, if appropriate, and the blanket 42 is appropriately folded. The case 12 is dimensioned to receive the blanket 42 and its accompanying weights 46 and the straps 28. Once the blanket 42 is secured within the case 12, the case 12 is closed and is attached to a belt 24 in appropriate fashion, or held by the handle 26 for easy transport.

While the invention has been particularly shown and described with reference to an embodiment thereof, it will be understood by those skilled in the art that various changes in form and detail may be made without departing from the spirit and scope of the invention.

I claim:

1. A ground covering system comprising:

a ground covering;

one or more weights attached to the ground covering;

a carrying case having a first half and a second half wherein the first half and second half are releasably securable to each other to contain the blanket;

a first strap connecting the first half to the ground covering at a first location; and a second strap connecting the second half to the ground covering at a second location.

2. The device as in claim 1 wherein the ground covering is a blanket.

3. The device as in claim 1 wherein the one or more weights are removably attached to the ground covering.

4. The device as in claim 1 wherein the one or more weights are removably attached to the ground covering by a hook and loop type fastener.

5. The device as in claim 1 wherein the one or more weights each include a clamp means, each of the clamp means having a pair of jaws, for friction holding the ground covering between each of the pairs of jaws.

6. The device as in claim 1 wherein the one or more weights are securely attached to the ground covering.

7. The device as in claim 6 wherein each of the one or more weights has a first spike.

8. The device as in claim 1 wherein the first half has a second spike and the second half has a third spike.

9. The device as in claim 1 wherein the case is attached to a belt for wearing around the waist of a user.

10. The device as in claim 9 wherein the case is removably attached to the belt.

11. The device as in claim 9 wherein the case is fixedly attached to the belt.

12. The device as in claim 1 wherein the first half is weighted and the second half is weighted.

13. The device as in claim 1 wherein the first half has a first slit for permitting the first strap to pass therethrough and the second half has a second slit for permitting the second strap to pass therethrough.

* * * * *